US010370885B1

(12) United States Patent
Kondratuk

(10) Patent No.: US 10,370,885 B1
(45) Date of Patent: Aug. 6, 2019

(54) HYDRAULIC DOOR CLOSER WITH FLUID OVERFLOW CHAMBER

(71) Applicant: Larson Manufacturing Company of South Dakota, Brookings, SD (US)

(72) Inventor: Michael W. Kondratuk, Brookings, SD (US)

(73) Assignee: Larson Manufacturing Company of South Dakota, Brookings, SD (US)

( * ) Notice: Subject to any disclaimer, the term of this patent is extended or adjusted under 35 U.S.C. 154(b) by 89 days.

(21) Appl. No.: 15/392,070

(22) Filed: Dec. 28, 2016

Related U.S. Application Data

(60) Provisional application No. 62/273,759, filed on Dec. 31, 2015.

(51) Int. Cl.
*E05F 3/14* (2006.01)
*E05F 3/10* (2006.01)
*E05F 3/12* (2006.01)

(52) U.S. Cl.
CPC ..... *E05F 3/102* (2013.01); *E05F 3/12* (2013.01); *E05F 3/14* (2013.01); *E05Y 2201/264* (2013.01); *E05Y 2201/474* (2013.01); *E05Y 2900/132* (2013.01)

(58) Field of Classification Search
CPC ..... E05F 3/00; E05F 3/04; E05F 3/10; E05F 3/102; E05F 3/12; E05F 3/14; E05F 3/18; E05Y 2201/264; E05Y 2201/474; E05Y 2900/132
USPC ..... 16/49, 51, 58, 59, 62
See application file for complete search history.

(56) References Cited

U.S. PATENT DOCUMENTS 3,852,846 A * 12/1974 Slaybaugh ..... E05F 3/223 16/48.5
4,378,612 A * 4/1983 Beers ..... E05F 3/12 16/49
4,580,365 A * 4/1986 Sieg ..... E05F 3/102 16/49
4,660,250 A * 4/1987 Tillman ..... E05F 1/006 16/58
4,937,913 A * 7/1990 Jentsch ..... E05F 3/102 16/51
4,967,444 A * 11/1990 Korling ..... E05F 3/223 16/48.5
5,259,090 A * 11/1993 Fayngersh ..... E05F 3/102 16/51
5,535,514 A * 7/1996 Lucas ..... E05F 3/102 16/62
7,571,515 B2 * 8/2009 Fischbach ..... E05F 3/102 16/64

(Continued)

FOREIGN PATENT DOCUMENTS

EP 328912 A1 * 8/1989

*Primary Examiner* — Roberta S Delisle
(74) *Attorney, Agent, or Firm* — Kagan Binder, PLLC

(57) ABSTRACT

This disclosure is generally directed to a hydraulic door closer, and more specifically is directed to a hydraulic storm or screen door closer that has a fluid overflow chamber providing fluid volume and pressure control for both expanded and contracted fluid at different temperatures. The disclosed hydraulic door closer comprises a fluid overflow chamber adapted to hold sufficient fluid to maintain required operating fluid or oil levels at different temperatures, and to ensure proper closer performance under both extreme high and low temperature conditions.

13 Claims, 9 Drawing Sheets

(56) References Cited

U.S. PATENT DOCUMENTS

| | | | | |
|---|---|---|---|---|
| 7,815,023 | B2 * | 10/2010 | Salutzki | C08L 59/02 16/52 |
| 8,613,126 | B2 * | 12/2013 | Blockley | E05F 3/12 16/51 |
| 2004/0205930 | A1 * | 10/2004 | Huang | E05F 3/00 16/64 |
| 2007/0256275 | A1 * | 11/2007 | Winkler | E05F 3/104 16/53 |

* cited by examiner

HYDRAULIC DOOR CLOSER WITH FLUID OVERFLOW CHAMBER

FIELD AND BACKGROUND OF THE INVENTION

This disclosure is generally directed to a hydraulic door closer, and more specifically is directed to a hydraulic storm or screen door closer that has a fluid overflow chamber providing fluid volume and pressure control for both expanded and contracted fluid at different temperatures.

Storm and screen doors present unique operating parameters for hydraulic door closer product specifications. For example, the temperature range that the closer must operate within is greater than, for example, an internal prime door closer because of the exposure to varying high and low outside temperatures as well as the potential heat buildup between the prime door and the storm or screen door. The heat buildup can be quite substantial and causes the increase in temperature and associated expansion of the hydraulic fluid or oil which subsequently results in a fluid pressure increase in the sealed closer containing the fluid or oil. The increased pressure typically results in fluid or oil leakage due to the intense pressure of the heated fluid.

SUMMARY

The present disclosure describes a pressure control overflow chamber for a rotational hydraulic door closer. This disclosure describes a closer having reduced pressures at high operating temperatures, provides means to maintain required operating fluid or oil levels at low temperatures, and ensures proper closer performance under both extreme high and low temperature conditions.

In one embodiment, the hydraulic door closer comprises a fluid overflow chamber adapted to hold sufficient fluid when the fluid is in both an expanded and contracted state.

In another embodiment, the hydraulic door closer comprises a fluid chamber having a predetermined volume sufficient to hold an expanded fluid at an elevated temperature.

In still another embodiment, the hydraulic door closer comprises an amount of fluid maintained in an overflow chamber so when the fluid contracts there is sufficient fluid in the closer.

In some embodiments, the fluid overflow chamber is a vertical chamber. In other embodiments, the fluid chamber is a horizontal chamber, or is an angled chamber. In still other embodiments, the fluid overflow chamber is located in the closer housing surrounding the hydraulic fluid, or is located within the hydraulic fluid itself.

In still another embodiment, the hydraulic door closer comprises a housing filled with fluid fitted with i) a biasing spring such as, for example a compression spring, attached to a piston having geared teeth and a check valve, ii) a geared pinion, iii) speed control chamber, and iv) an overflow chamber adapted to hold sufficient fluid in both an expanded and contracted state. This embodiment may further comprise a speed control valve as well as horizontal and vertical speed control chamber plugs. This embodiment may also comprise an overflow chamber check valve or screw plug.

Figure 1:
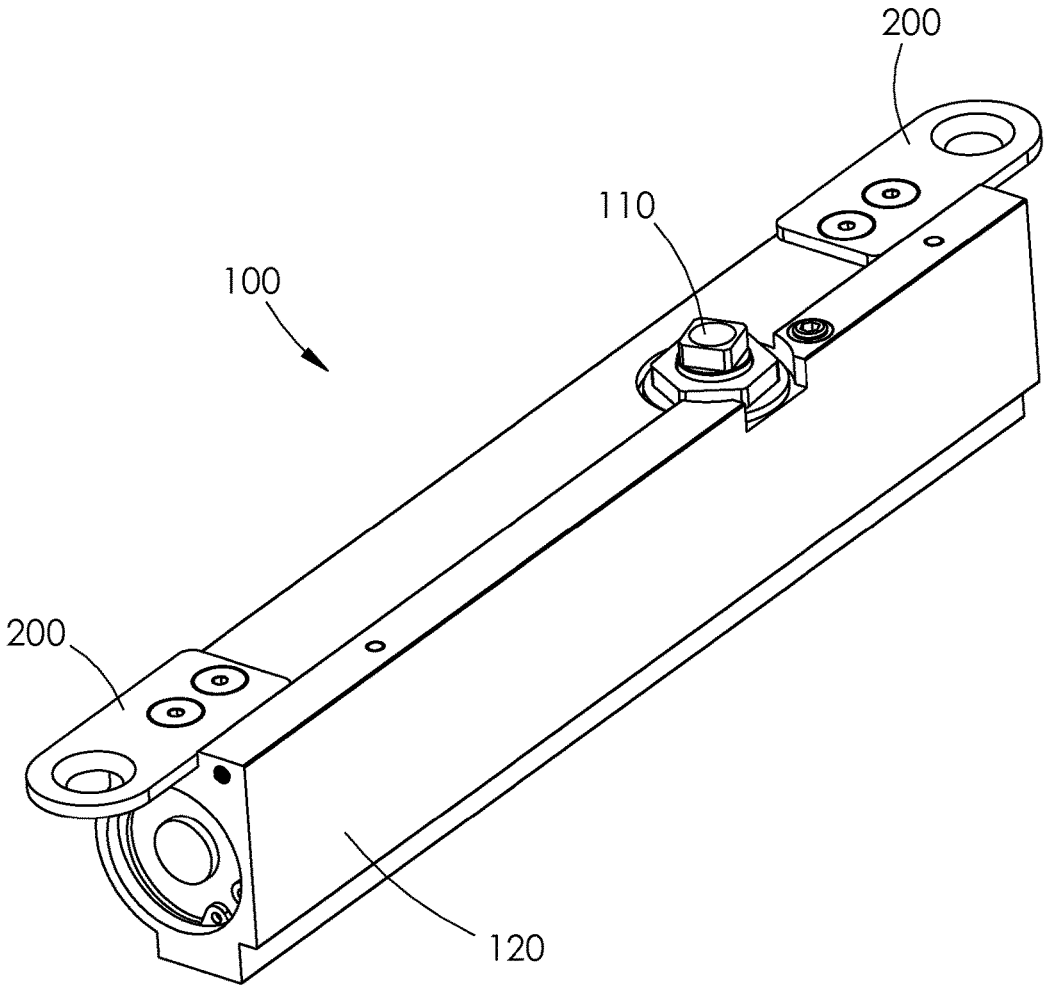
FIG. 1 is an isometric view of a rotational hydraulic closer.

In the listed figures, the described components have the reference numerals set out in the following table:

| Component | Feature | Description |
|---|---|---|
| 100 | | Rotational Hydraulic Closer |
| 110 | | Pinion |
| | 112 | Pinion gear teeth |
| 120 | | Housing |
| | 121 | Overflow connecting chamber |
| | 123 | Horizontal overflow chamber |
| | 124 | Vertical overflow chamber |
| | 125 | Angular overflow chamber |
| 140 | | Overflow chamber vertical plug |
| 183 | | Horizontal overflow chamber screw plug |
| 184 | | Vertical overflow chamber screw plug |
| 185 | | Angular overflow chamber screw plug |
| 190 | | Closer piston |
| | 192 | Piston gear teeth |
| | 194 | Sealing portion of closer piston |
| 200 | | Mounting tab |
| 210 | | Biasing spring |
| 220 | | Valve, speed control |
| 230 | | Pressurized side of piston |
| 240 | | Unpressurized side of piston |
| 250 | | Speed control chamber |
| 260 | | Vertical speed control chamber plug |
| 270 | | Horizontal speed control chamber plug |
| 280 | | Overflow chamber piston |
| 281 | | Overflow chamber piston seal |
| 282 | | Overflow chamber spring |

DETAILED DESCRIPTION OF THE INVENTION

The disclosed hydraulic door closer having an overflow chamber or reservoir is particularly intended for use in a hydraulic door closer for a storm or screen door, but may provide useful benefits in other closer applications that are subject to a wide range of temperatures.

The incorporation of the overflow chamber or reservoir within the closer allows a space for the oil to expand in high temperature situations which controls or tempers the pressure build up and eliminates the oil leakage condition associated with high internal fluid pressures. It may be desirable to incorporate a small one way check valve in the overflow chamber, which will work to reduce or eliminate any back pressure in the closer as the temperature and pressure change during use. This also serves as a means to allow the overflow chamber to be open to ambient air pressure.

In addition to the expansion due to high temperature, the overflow or expansion chamber may also provide a benefit in cold temperatures by maintaining a prescribed fluid or oil volume such that the fluid level never becomes too low during cold temperature and fluid contraction resulting from the cold temperature. This is accomplished by having a fluid amount maintained in the overflow chamber so when the fluid or oil contracts, there is sufficient fluid volume in the closer at the predetermined low temperature requirement.

With the incorporation of the overflow expansion chamber, the oil pressure and oil level is maintained to a pressure which prevents leakage and provides a consistent oil operating level ensuring proper closer performance at the temperature extremes experienced by storm and screen doors.

Referring to FIG. 1, the generalized configuration of a rotationally activated hydraulic door closer (100) is illustrated. In the assembled state, the door closer is comprised of a housing (120), a pinion (110) in which an arm (not shown) is typically attached to transfer angular torque from the closer to the door, and mounting tab(s) (200) to affix the closer to the door or a door frame.

Figure 2:
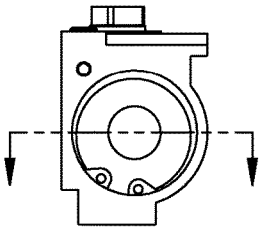
FIG. 2 is a side view of the closer defining the cross section for FIG. 3.
Figure 3:
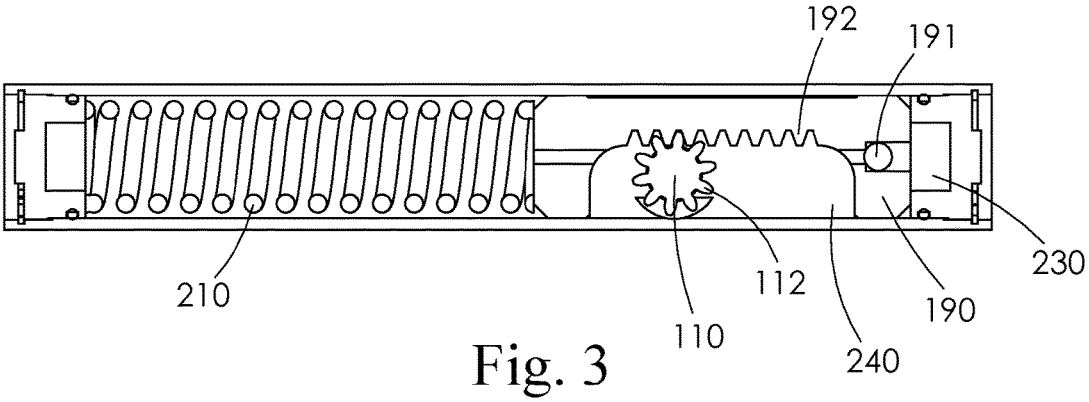
FIG. 3 is a cross-sectional top view of the closer as defined by FIG. 2.

Referring to FIG. 3, which is a cross-sectional top view of the closer as defined by FIG. 2, there is a biasing spring (210), a piston (190) with check valve (191), and a pinion (110). Also within the closer is fluid, typically an oil or oil derivative, which is used to dampen the speed of the closer. As the piston moves transversely within the closer body, the pinion (110) rotates as a result of the engagement between the teeth (192) of the piston and the teeth (112) of the pinion, causing the closer arm (not shown) to rotate and pull the door closed. When a closer arm (not shown) is attached to the pinion and rotated as the door is opened, the pinion gear teeth (112) apply a force to the piston gear teeth (192) to move the piston (190) in a direction that further compresses the spring and causing fluid to flow from the unpressurized side of the piston through one-way check valve (191) to the pressurized side of the piston. When the door is released to close, the biasing spring urges the piston toward the pressurized side of the piston (230). Fluid on the pressurized side of the closer is displaced but is prevented from flowing back through the check valve so that fluid flows through the speed control chamber (not shown), and speed control valve (not shown) to the unpressurized side of the piston (240).

Figure 4:
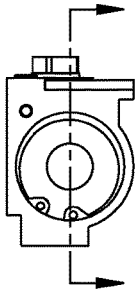
FIG. 4 is a side view of the closer defining the cross section for FIG. 5.
Figure 5:
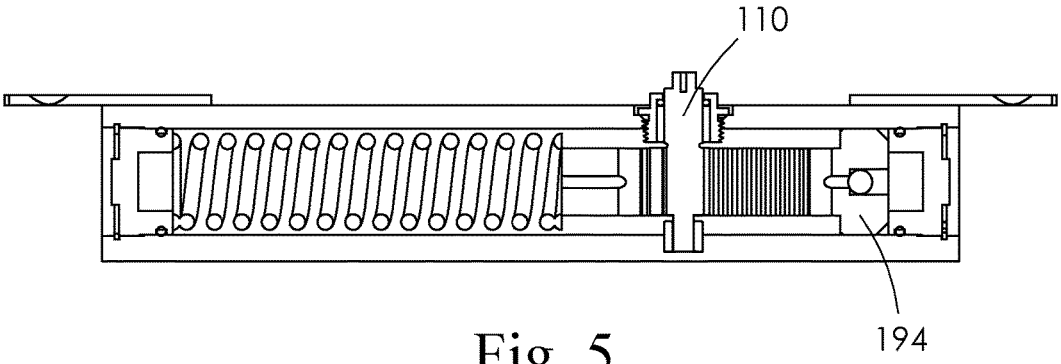
FIG. 5 is a cross-sectional front view of the closer as defined by FIG. 4.
Figure 6:
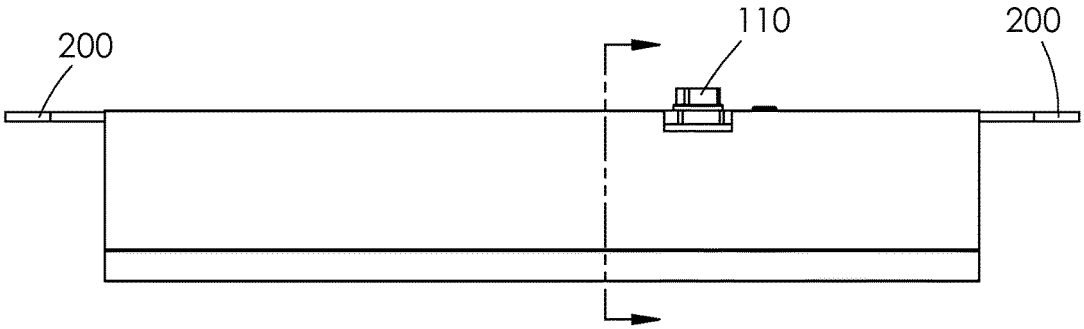
FIG. 6 is a front view of the closer defining the cross section for FIG. 7.
Figure 7:
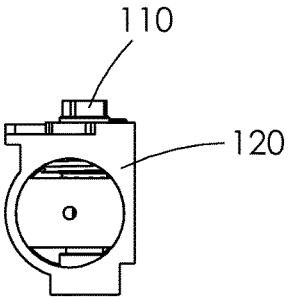
FIG. 7 is a cross-sectional side view of the closer as defined by FIG. 6.
Figure 8:
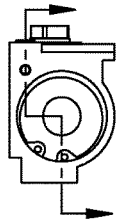
FIG. 8 is a side view of the closer defining the cross section for FIG. 9.

Additional cross-sectional, front and side views of the closer of FIG. 3 are illustrated in FIGS. 4-7. FIG. 5 is a cross-section front view of the closer as defined by FIG. 4 illustrating pinion (110) and the sealing portion of closer piston (194). FIG. 6 is a front view of the closer defining the cross section for FIG. 7 and illustrates pinion (110) and mounting tabs (200). FIG. 7 is a cross section defined by FIG. 6 and illustrates pinion (110) and housing (120).

Figure 9:
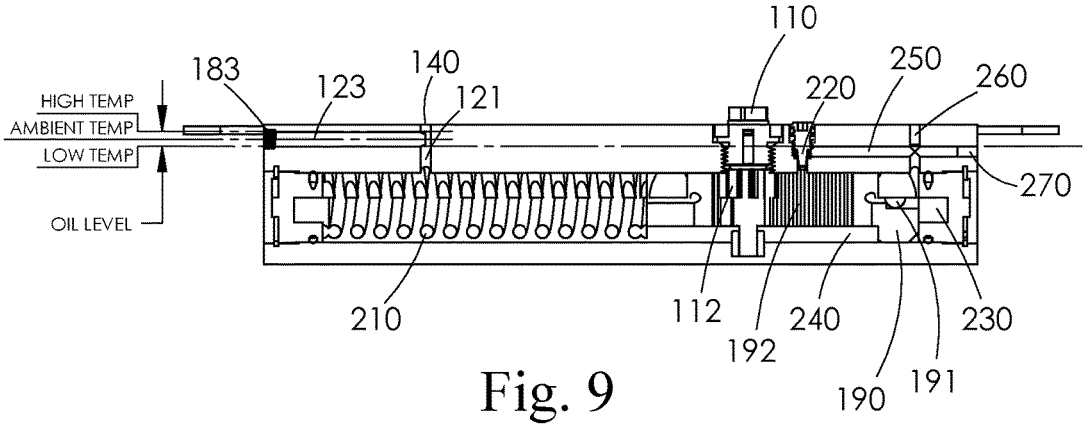
FIG. 9 is a cross-sectional front view of the closer as defined by FIG. 8, which shows an overflow chamber in a horizontal orientation.
Figure 10:
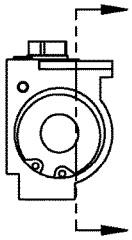
FIG. 10 is a side view of the closer defining the cross section for FIG. 11.

Referring to FIG. 9, chamber (123) is an overflow chamber with horizontal overflow chamber screw plug (183) and overflow chamber vertical plug (140) for an embodiment which relies on fluid dynamics to allow fluid volume fluctuation based upon temperature changes. The chamber in this embodiment is oriented horizontally, and via an overflow connecting chamber (121) permits the expansion and contraction of fluid volume based upon temperature changes while maintaining an overall internal oil level and pressure that allows the closer to operate normally. By allowing the internal oil to expand and contract in the overflow chamber as temperature increases and decreases, the oil pressure is maintained at essentially the same pressure as at ambient temperatures, and prevents the oil leaks previously described. Furthermore, sizing and locating the overflow chamber properly ensures the oil level remains at the level necessary to ensure normal operation of the closer at all temperatures. That is, even when the oil contracts and the oil level drops to the low temperature line as depicted in FIG. 9, there is still sufficient oil within the closer to allow the closer to operate normally.

In FIG. 9, the fluid is typically regulated by a speed control valve (220), to control the flow of fluid from the pressurized side of the piston (230) to the unpressurized side (240) of the piston. The biasing spring in this embodiment is under compression when assembled within the closer. The spring exerts a biasing load on the piston, which is in the neutral state as illustrated, and is balanced within the housing resulting in no torque at the pinion. When a closer arm (not shown) is attached to the pinion (110) and rotated as the door is opened, the pinion gear teeth (112) apply a force to the piston gear teeth (192) to move the piston (190) in a direction that further compresses the spring and causing fluid to flow from the unpressurized side of the piston through one-way check valve (191) to the pressurized side of the piston. When the door is released to close, the biasing spring urges the piston toward the pressurized side of the piston (230). Fluid on the pressurized side of the closer is displaced and flows through the speed control chamber (250), and valve (220) to the unpressurized side of the piston (240).

Figure 11:
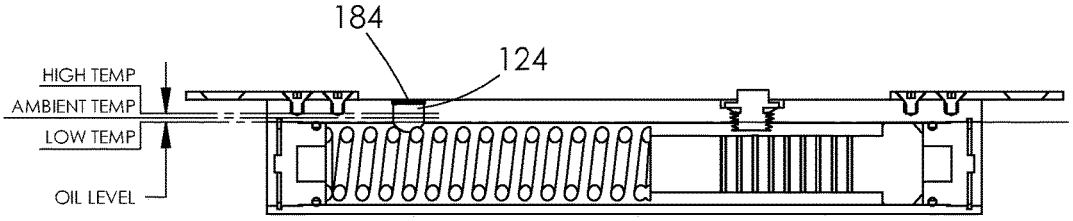
FIG. 11 is a cross-sectional front view of the closer as defined by FIG. 10, which shows an overflow chamber in a vertical orientation.
Figure 12:
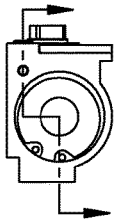
FIG. 12 is a side view of the closer defining the cross section for FIG. 13.

Referring to FIG. 11, chamber (124) is an overflow chamber with vertical overflow chamber screw plug (184) for an alternate embodiment which relies on fluid dynamics to allow fluid volume fluctuation based upon temperature changes. The chamber in this embodiment is oriented vertically, and permits the expansion and contraction of fluid volume based upon temperature changes while maintaining an overall internal oil level and pressure that allows the closer to operate normally. As with the horizontal chamber, the oil pressure and level is maintained at levels that ensure normal operation of the closer at all temperatures.

Figure 13:
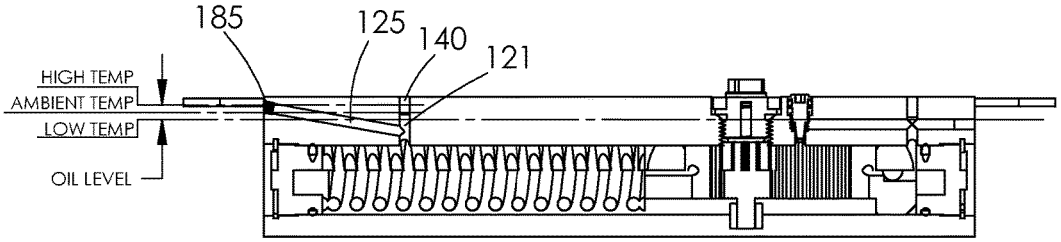
FIG. 13 is a cross-sectional front view of the closer as defined by FIG. 12, which shows an overflow chamber in an angular orientation.

Referring to FIG. 13, chamber (125) is an active overflow chamber with angular overflow chamber screw plug (185) for yet another embodiment which relies on fluid dynamics to allow fluid volume fluctuation based upon temperature changes. The chamber in this embodiment is oriented at an angle, and permits the expansion and contraction of fluid volume based upon temperature changes while maintaining an overall internal oil level and pressure that allows the closer to operate normally. As with the horizontal and vertical chambers, the oil pressure and level is maintained at levels that ensure normal operation of the closer at all temperatures.

Figures 14, 14A, 14B, 14C:
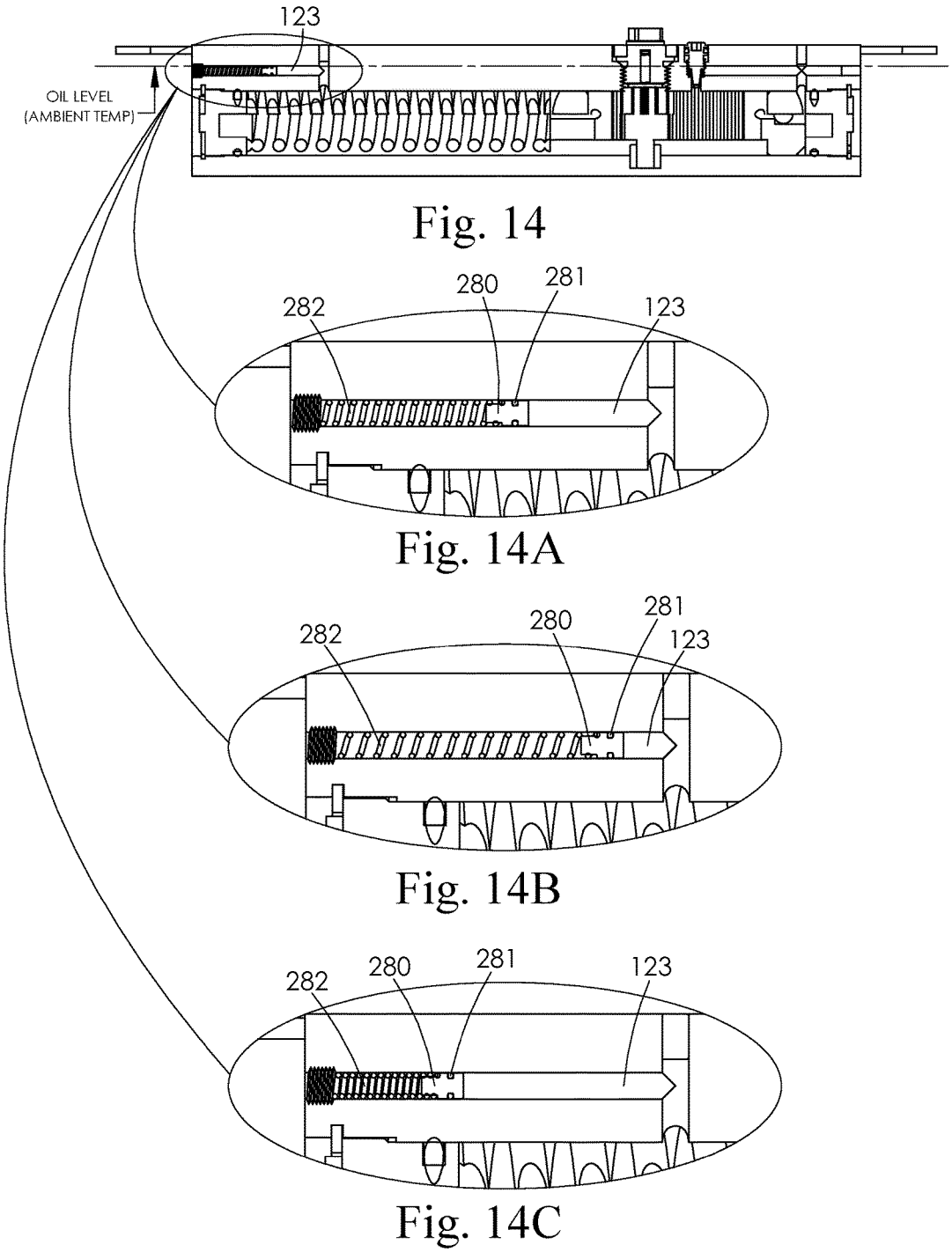
FIGS. 14, 14A, 14B and 14C illustrate a horizontal fluid chamber containing an overflow chamber piston, overflow chamber piston seal, and overflow chamber spring.
Figure 15:
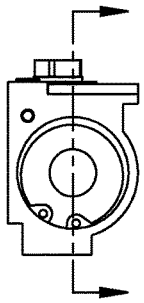
FIG. 15 is a side view of the closer defining the cross section for FIG. 16.

FIG. 14 illustrates another embodiment having a spring-biased piston in the overflow chamber. The addition of a spring-biased piston in the overflow chamber further enhances the operational performance of the closer. In the horizontally-oriented chamber depicted in FIG. 14, for example, overflow chamber (123) contains a piston (280) backed by a spring (282) and carrying a piston seal (281). The piston would be located at an intermediate position within the overflow chamber at an ambient (room temperature) state. This intermediate position is illustrated in FIG. 14A showing an enlargement of the overflow chamber components of FIG. 14. In a low temperature state, the fluid within the closer would contract due to a decrease in temperature. This would decrease the volume of the oil and the spring-biased overflow chamber piston would move in a direction decreasing the volume within the overflow chamber, but yet maintaining an overall internal oil level and pressure within the closer allowing the closer to operate normally. This low temperature configuration of the overflow components is illustrated in FIG. 14*b*. Alternately, in a high temperature state, the oil within the closer would expand due to an increase in temperature. This would increase the volume of the oil and the overflow chamber piston would move in a direction increasing the volume within the overflow chamber, but yet maintaining an overall internal oil level and pressure within the closer allowing the closer to operate normally. This high temperature configuration of the overflow chamber components is illustrated in FIG. 14*c*. The spring (282) that biases the piston must be carefully sized such that throughout the entire operating temperature range of the closer, the expanding oil can overcome the spring force and increase the effective volume of the overflow chamber as the oil temperature increases; yet while the oil temperature decreases and the oil contracts, the spring force can overcome the force of friction between the piston seal and overflow chamber thereby allowing the spring to extend and reduce the effective volume of the overflow chamber.

Figure 16:
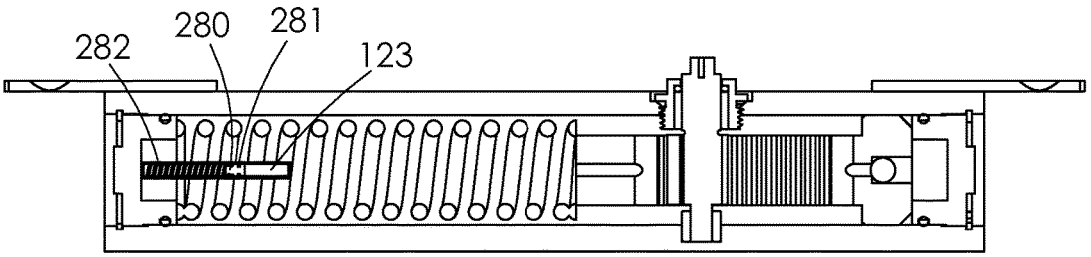
FIG. 16 is a cross-sectional front view of the closer as defined by FIG. 15 which shows an overflow chamber in a horizontal orientation in the interior region of the closer defined by the biasing spring.

Referring to FIG. 16, chamber (123) is a horizontal overflow chamber with horizontal overflow chamber having a spring-biased piston (280) in the overflow chamber. The chamber in this embodiment is located in an interior region of the closer defined by the inside diameter of the biasing spring and permits the expansion and contraction of fluid volume based upon the positions of the overflow chamber piston (280) with related overflow chamber piston seal (281) and overflow chamber spring (282) in the overflow chamber to maintain an overall internal oil level and pressure that allows the closer to operate normally at all temperatures. By allowing the internal oil to expand and contract in the overflow chamber as temperature increases and decreases, the oil pressure is maintained at essentially the same pressure as at ambient temperatures, and prevents the oil leaks previously described.

What is claimed is:

1. A hydraulic door closer comprising a housing filled with fluid fitted with i) a biasing spring attached to a piston having geared teeth and a check valve, ii) a geared pinion, iii) a speed control chamber, and iv) a fluid overflow chamber adapted to hold sufficient fluid when the fluid is in both an expanded and contracted state, the fluid overflow chamber comprising an overflow chamber piston, an overflow chamber piston seal, and an overflow chamber spring.

2. The hydraulic door closer of claim 1, further comprising a speed control valve.

3. The hydraulic door closer of claim 1, further comprising horizontal and vertical speed control chamber plugs.

4. The hydraulic door closer of claim 1, further comprising an overflow chamber check valve.

5. The hydraulic door closer of claim 1, wherein the biasing spring is a compression spring.

6. The hydraulic door closer of claim 1, wherein the fluid overflow chamber is a vertical chamber, a horizontal chamber, or an angled chamber.

7. The hydraulic door closer of claim 1, wherein the fluid overflow chamber is in an interior region of the closer.

8. A hydraulic door closer comprising a housing filled with fluid fitted with i) a biasing spring attached to a piston having geared teeth and a check valve, ii) a geared pinion, iii) a speed control chamber, iv) a fluid overflow chamber having a predetermined volume sufficient to hold an expanded fluid at an elevated temperature, the fluid overflow chamber comprising an overflow chamber piston, an overflow chamber piston seal, and an overflow chamber spring.

9. The hydraulic door closer of claim 8, wherein the fluid overflow chamber is in an interior region of the closer.

10. The hydraulic door closer of claim 8, wherein the fluid overflow chamber is a vertical chamber, a horizontal chamber, or an angled chamber.

11. A hydraulic door closer comprising a housing filled with fluid fitted with i) a biasing spring attached to a piston having geared teeth and a check valve, ii) a geared pinion, iii) a speed control chamber, and iv) a fluid overflow chamber, wherein the fluid overflow chamber comprises an overflow chamber piston, an overflow chamber piston seal, and an overflow chamber spring, and wherein the fluid overflow chamber maintains an amount of the fluid so that when the fluid contracts there is sufficient fluid in the closer.

12. The hydraulic door closer of claim 11, wherein the fluid overflow chamber is a vertical chamber, a horizontal chamber, or an angled chamber.

13. The hydraulic door closer of claim 11, wherein the fluid overflow chamber is in an interior region of the closer.

* * * * *